US008241142B2

(12) United States Patent
Evans et al.

(10) Patent No.: US 8,241,142 B2
(45) Date of Patent: Aug. 14, 2012

(54) GOLF CLUB HEAD WITH IMPROVED AERODYNAMIC CHARACTERISTICS

(75) Inventors: D. Clayton Evans, San Marcos, CA (US); Evan D. Gibbs, Encinitas, CA (US); Matthew T. Cackett, San Diego, CA (US); Steven M. Ehlers, Poway, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 13/166,589

(22) Filed: Jun. 22, 2011

(65) Prior Publication Data

US 2012/0015757 A1 Jan. 19, 2012

Related U.S. Application Data

(60) Provisional application No. 61/365,233, filed on Jul. 16, 2010.

(51) Int. Cl.
*A63B 53/04* (2006.01)

(52) U.S. Cl. ..... 473/345

(58) Field of Classification Search ..... 473/324–350
See application file for complete search history.

(56) References Cited

U.S. PATENT DOCUMENTS

| | | | | |
|---|---|---|---|---|
| 1,587,758 | A | 6/1926 | Charavay | |
| 3,595,577 | A | 7/1971 | Hodge | |
| 4,065,133 | A | 12/1977 | Gordos | |
| 4,930,783 | A | 6/1990 | Antonious | |
| 5,094,457 | A * | 3/1992 | Kinoshita | 473/314 |
| 5,120,061 | A | 6/1992 | Tsuchida et al. | |
| 5,203,565 | A | 4/1993 | Murray et al. | |
| 5,318,297 | A | 6/1994 | Davis et al. | |
| 5,575,725 | A | 11/1996 | Olsavsky | |
| 5,674,136 | A | 10/1997 | Gorse et al. | |
| 5,935,020 | A * | 8/1999 | Stites et al. | 473/345 |
| 5,961,397 | A | 10/1999 | Lu et al. | |
| 6,027,414 | A | 2/2000 | Koebler | |
| 6,048,278 | A | 4/2000 | Meyer et al. | |
| 6,648,773 | B1 * | 11/2003 | Evans | 473/342 |
| 6,994,636 | B2 * | 2/2006 | Hocknell et al. | 473/342 |
| 7,097,572 | B2 * | 8/2006 | Yabu | 473/329 |
| 7,163,468 | B2 | 1/2007 | Gibbs et al. | |
| 7,163,470 | B2 | 1/2007 | Galloway et al. | |
| 7,166,038 | B2 | 1/2007 | Williams et al. | |
| 7,214,143 | B2 | 5/2007 | Deshmukh | |
| 7,252,600 | B2 | 8/2007 | Murphy et al. | |
| 7,258,626 | B2 | 8/2007 | Gibbs et al. | |
| 7,258,631 | B2 | 8/2007 | Galloway et al. | |
| 7,273,419 | B2 | 9/2007 | Evans et al. | |
| 7,713,138 | B2 | 5/2010 | Sato et al. | |
| 7,785,214 | B2 * | 8/2010 | Horacek et al. | 473/345 |
| 8,083,609 | B2 * | 12/2011 | Burnett et al. | 473/327 |
| 8,088,021 | B2 * | 1/2012 | Albertsen et al. | 473/327 |

(Continued)

*Primary Examiner* — Alvin Hunter
(74) *Attorney, Agent, or Firm* — Rebecca Hanovice; Michael A. Catania; Sonia Lari

(57) ABSTRACT

Methods of forming a golf club head having improved aerodynamic characteristics are disclosed herein. A preferred method is the largest tangent circle method, which utilizes a Cartesian coordinate system. The method results in identification and measurement of certain club head features, which can be adjusted to improve aerodynamic properties of the golf club head. One method of the present invention lowers the drag of the club head by specifying dimensional relationships of the driver head based on location of apex and nadir points, while another method lowers the drag of the club head by improving overall face design.

7 Claims, 11 Drawing Sheets

U.S. PATENT DOCUMENTS

| | | | | |
|---|---|---|---|---|
| 2005/0032584 | A1 | 2/2005 | Van Nimwegen | |
| 2009/0075754 | A1 * | 3/2009 | Horacek et al. | 473/349 |
| 2009/0318245 | A1 | 12/2009 | Yim et al. | |
| 2010/0009771 | A1 | 1/2010 | Newcomer | |
| 2010/0016095 | A1 | 1/2010 | Burnett et al. | |
| 2010/0016096 | A1 | 1/2010 | Burnett et al. | |
| 2010/0016097 | A1 | 1/2010 | Albertsen et al. | |
| 2010/0279788 | A1 * | 11/2010 | Horacek et al. | 473/324 |
| 2010/0292020 | A1 | 11/2010 | Tavares et al. | |
| 2010/0311517 | A1 | 12/2010 | Tavares et al. | |
| 2011/0136584 | A1 | 6/2011 | Boyd et al. | |
| 2012/0015757 | A1 * | 1/2012 | Evans et al. | 473/327 |

* cited by examiner

GOLF CLUB HEAD WITH IMPROVED AERODYNAMIC CHARACTERISTICS

CROSS REFERENCES TO RELATED APPLICATIONS

The present application claims priority to U.S. Provisional Patent Application Ser. No. 61/365,233, filed on Jul. 16, 2010.

STATEMENT REGARDING FEDERALLY SPONSORED RESEARCH OR DEVELOPMENT

Not Applicable

BACKGROUND OF THE INVENTION

1. Field of the Invention

The present invention relates to designs and methods for reducing the effects of drag force when using a driver.

2. Description of the Related Art

Golf club driver designs have recently trended to include characteristics intended to increase the driver's inertia values to help off-center hits go farther and straighter. Driver designs have also recently included larger faces, which may help the driver deliver better feeling shots as well as shots that have higher ball speeds if hit away from the face center. These recent trends can, however, be detrimental to the driver's performance due to the head speed reductions that these design features introduce due to the larger geometries. The prior art generally fails to provide driver designs that efficiently reduce drag forces and consequentially enable the driver to be swung faster along its path and contribute to an improved impact event with the golf ball.

The United States Golf Association (USGA) has increasingly limited the performance innovations of golf clubs, particularly drivers. Recently, the USGA has limited the volume, dimensions of the head, such as length, width, and height, face compliance, inertia of driver heads and overall club length. Current methods previously used to improve the performance of a driver have been curtailed by limitations on design parameters set by the USGA.

An area of driver performance improvement that exists, as of this date, is the potential to reduce the drag force that opposes the driver's travel through the air during its path to the golf ball on the tee. A reduction in drag force would allow the driver club head to travel faster along its path and contribute to an improved impact event with the golf ball, resulting in higher golf ball velocities and consequentially, in longer golf shots. The purpose of the present invention is to effectively incorporate several design features in the driver club head that will enable lower drag coefficients as the driver is swung by a golfer. The design features will reduce drag forces and consequently allow the driver to be swung faster than conventional driver designs that currently exist. Improving the drag coefficients of the face, crown and sole surfaces will reduce the overall drag forces that impede the driver club head from moving faster through the air and the head speed of the driver is increased by approximately 1 to 5 mph.

BRIEF SUMMARY OF THE INVENTION

The designs and methods of the present invention relate to cross-sectional dimensional relationships between the face, the transitional surfaces which join the face and blend into body surfaces of the club head, and the body surfaces themselves, and the two-dimensional face area as compared with the two-dimensional area of a silhouette of the club head. The present invention provides for drivers with higher inertias, larger volumes, and robust face designs in addition to driver designs that lower the drag forces on the club head, improve drag coefficients on the face, sole, and crown surfaces, and increase the head speed during a swing, thus enabling all shots, whether at the sweet spot or off-center, to have higher ball speeds and longer driving distances.

One objective of the present invention is to lower the drag of the club head by improving the overall driver body design. To improve body design of the driver club head, specific dimensions A, B, C, D, E, and H, and more particularly dimensions A, B, D, and E are set such that the driver's dimensions comply with one or more of the following formulas:

$$((A+B)/C) \geqq 30\%$$

$$A \geqq 0.36 \text{ inches and } D > 1.0 \text{ inch}$$

$$B \geqq 0.3 \text{ inches and } E > 1.0 \text{ inch}$$

$$A \geqq 0.25 \text{ inches and } C \leqq 2.0 \text{ inches}$$

$$B \geqq 0.25 \text{ inches and } C \leqq 2.0 \text{ inches}$$

$$A \geqq 0.25 \text{ inches and } B \geqq 0.25 \text{ inches AND } C \geqq 2.0 \text{ inches}$$

$$C/H < 80\%$$

Another objective of the present invention is to lower the drag of the club head by improving the overall face design. To improve face design, the overall two-dimensional projected areas of the driver face and the driver club head silhouette are derived, and then are set such that the driver's area dimensions comply with the following formula: (two-dimensional projected face area/two-dimensional projected driver club head silhouette area)<59%

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
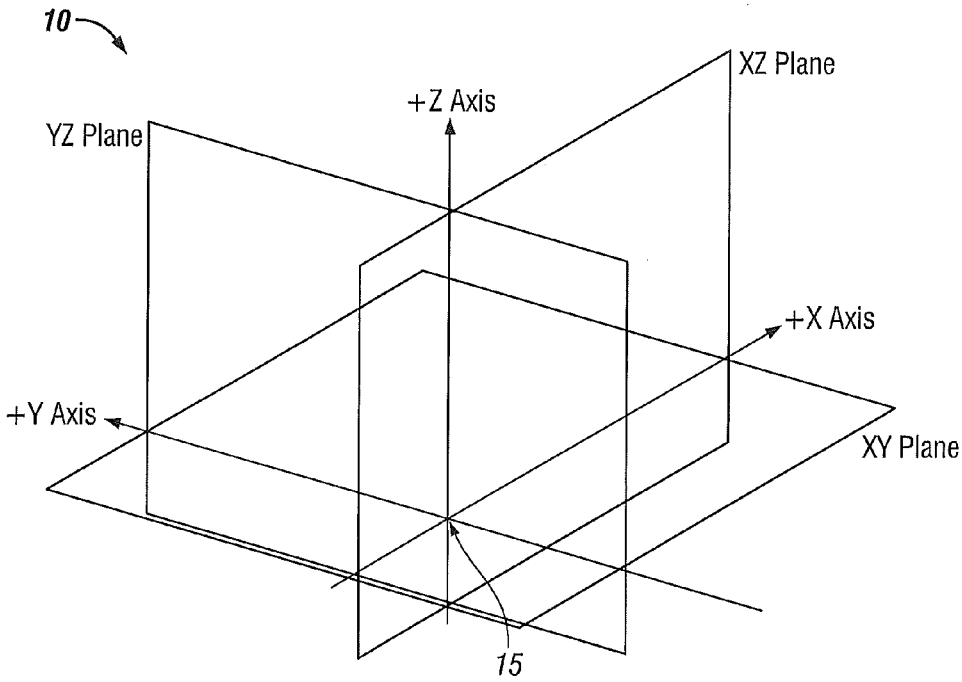
FIG. 1 is a Cartesian coordinate system for use with a method of the present invention.

The present invention relates to design relationships and methods of measurement to improve the shape of a driver golf club head 20. To verify the existence of conforming or non-conforming geometries of a driver club head 20, a specific club head orientation with respect to a Cartesian Coordinate System (CCS) is used and is described herein. An exemplary CCS having an origin point 15 is shown in FIG. 1.

Figure 2:
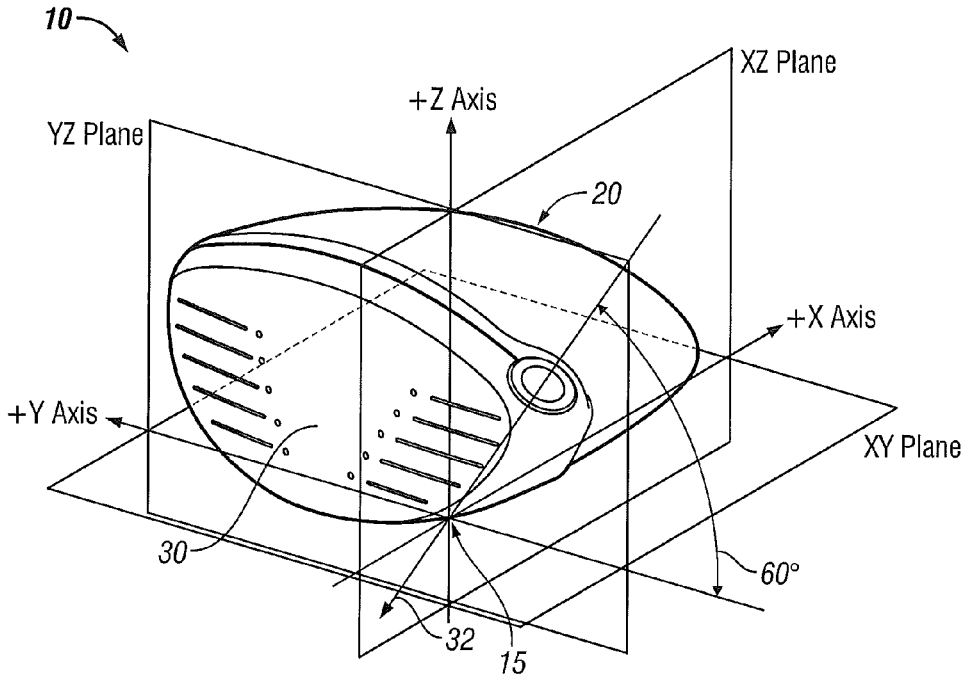
FIG. 2 is a perspective view of a golf club head superimposed on a Cartesian coordinate system according to a method of the present invention.

As shown in FIG. 2, a driver club head 20 is oriented onto a CCS where three perpendicular planes exist. The point at which all three planes intersect each other is called the origin point 15. The resulting lines of intersection of the three planes with each other are perpendicular lines representing the axis of the CCS, with each line or axis labeled appropriately X, Y, and Z and passing through the origin point of the CCS. The values on either side of the origin of the X, Y, and Z axis are labeled either positive or negative, as defined and understood in the CCS.

In the preferred embodiment, the club head 20 placed within the CCS comprises a hosel 24 having a hosel axis 32, a crown 26, a sole 25 and a face 30, as shown in FIG. 2. Preferably, the driver type golf club head 20 placed within the CCS has a volume of less than 500 cubic centimeters. Preferably, the sole 25 is composed of a metal material and the crown 26 is composed of a non-metal material. The sole of the golf club head 20 preferably is composed of a titanium alloy material.

The driver golf club head 20 is oriented in the CCS in such a manner that the hosel line 32 lies in the YZ plane and passes through the origin point 15 of the CCS. The driver golf club head 20 is further oriented such that the hosel axis line 32 of the golf club head 20 lies at a 60 degree angle measured from the −Y axis, as shown in FIGS. 2, 4, and 6.

Figure 6:
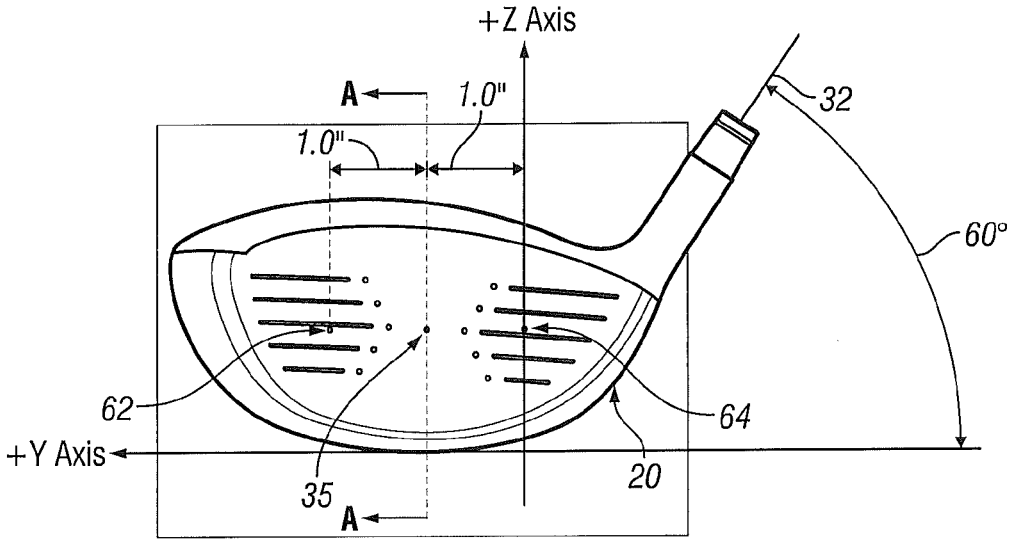
FIG. 6 is a perspective view of a golf club head superimposed on the Y and Z axes of a Cartesian coordinate system showing a hosel axis and its angle with respect to the Y axis, heel and toe contact points, and the face center point.
Figure 7:
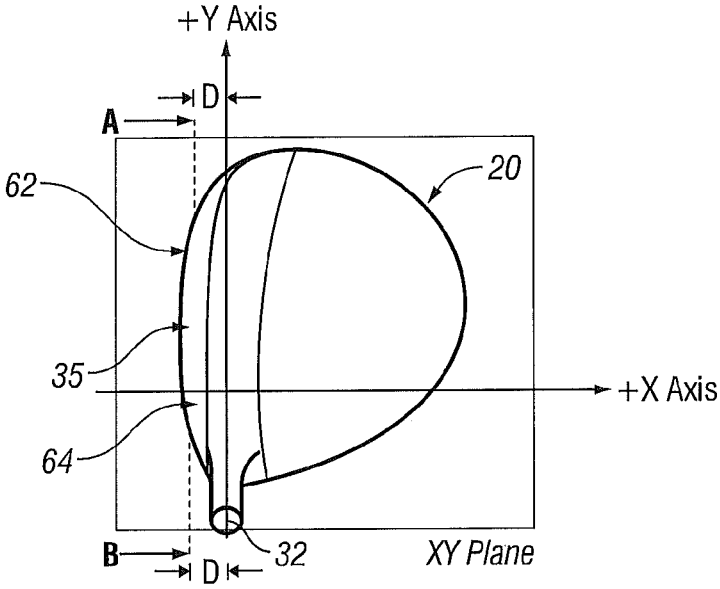
FIG. 7 is a perspective view of a golf club head superimposed on the Y and X axes of a Cartesian coordinate system showing toe and heel points and the face center point.

Once the club head 20 is oriented as described above, it is further adjusted by rotating the club head 20 around the hosel axis line 32 until two points, a toe point 62 and a heel point 64, each of which are approximately one inch on either side of the face center point 35, have the same distance D to the YZ plane, as shown in FIGS. 6 and 7.

Figure 3A:
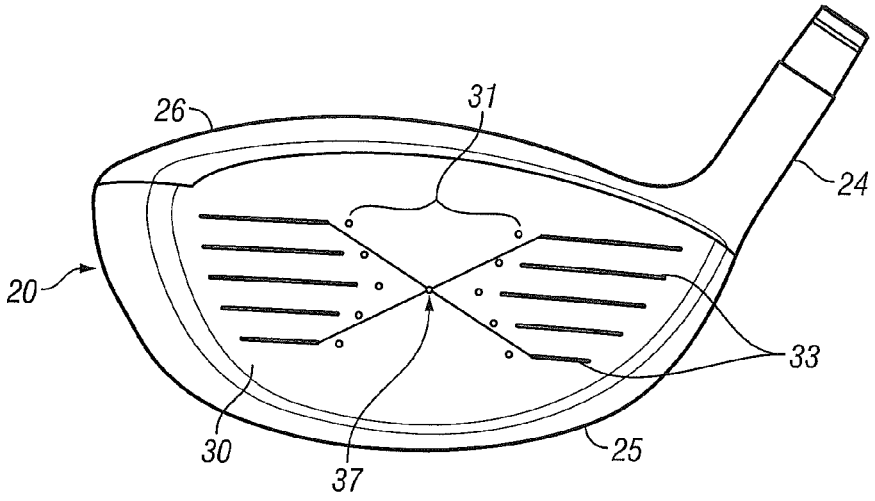
FIG. 3A is a perspective view of a golf club head showing the location of the horizontal face center of the club head.
Figure 3B:
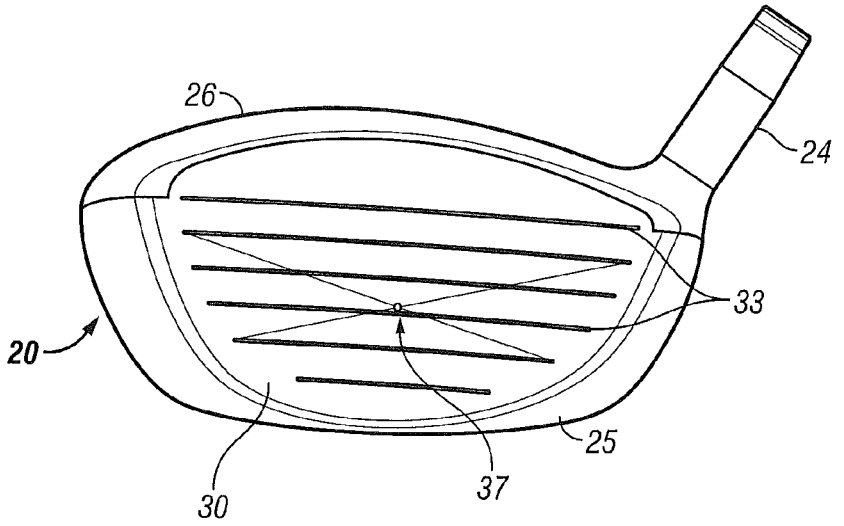
FIG. 3B is a perspective view of a golf club head showing the location of the horizontal face center of the club head.

The horizontal face center point 37 can be located as shown in FIGS. 3A and 3B. If the golf club face 30 has scorelines 33 with a blank space 31 in the middle, as shown in FIG. 3A, diagonal lines are drawn from the central ends of the upper scorelines 33 to the central ends of the lower scorelines 33 across the blank space 31 to locate the horizontal center point 37. If the golf club face 30 has scorelines 33 stretching across the face 30, diagonal lines are drawn from the ends of the second scoreline 33 from the top to the ends of the second scoreline 33 from the bottom, as shown in FIG. 3B. In both FIGS. 3A and 3B, the horizontal center point 37 is located where the diagonal lines intersect.

Figure 4:
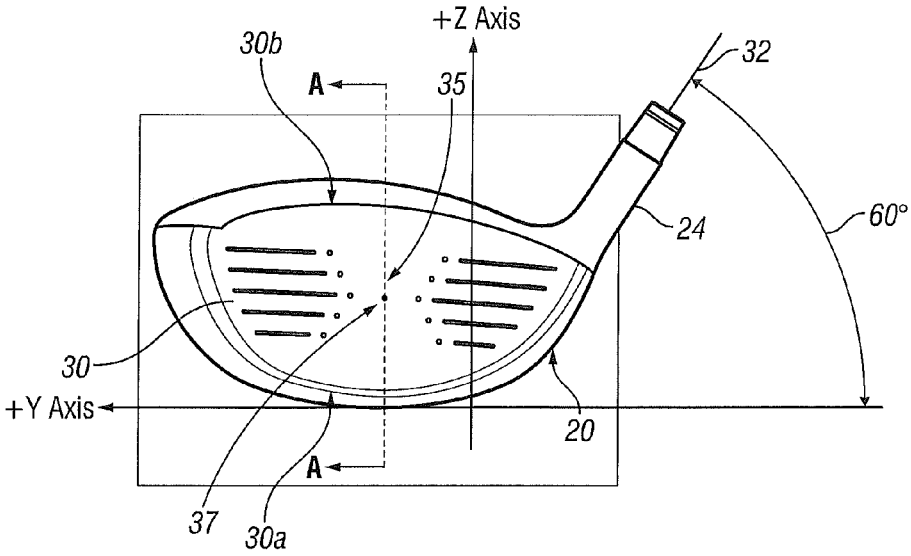
FIG. 4 is a perspective view of a golf club head superimposed on the Y and Z axes of a Cartesian coordinate system showing a hosel axis and its angle with respect to the Y axis and the locations of the top of the face, the bottom of the face, the face center point, and the horizontal center of the face.
Figure 5:
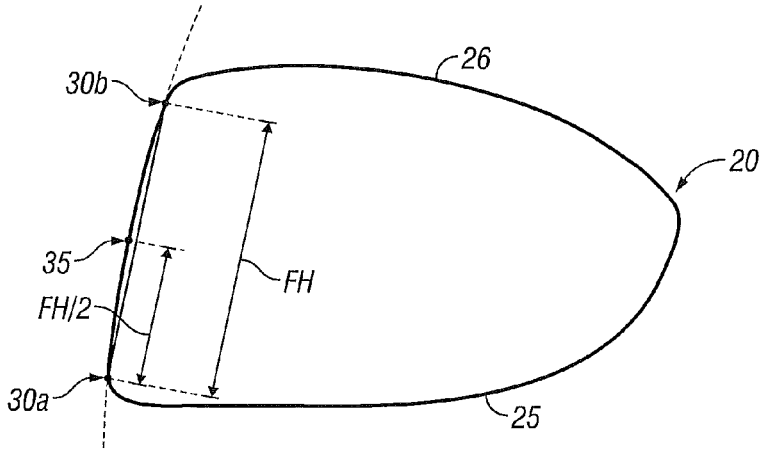
FIG. 5 is a two-dimensional cross sectional view of the golf club head in FIG. 5, showing dimensions of the face, including the center of the face.

The face center point 35 is shown in FIGS. 4 and 5, which illustrate how to define the face center point 35 in relation to the bottom 30*a* and top 30*b* of the club face 30. As shown in these Figures, the golf club head 20 is sectioned along lines A-A parallel to the Z axis through the horizontal face center point 37 measured along the Y axis, and the height FH of the face 30 is measured and divided in half to arrive at the location of the center of the face 35.

Figure 8:
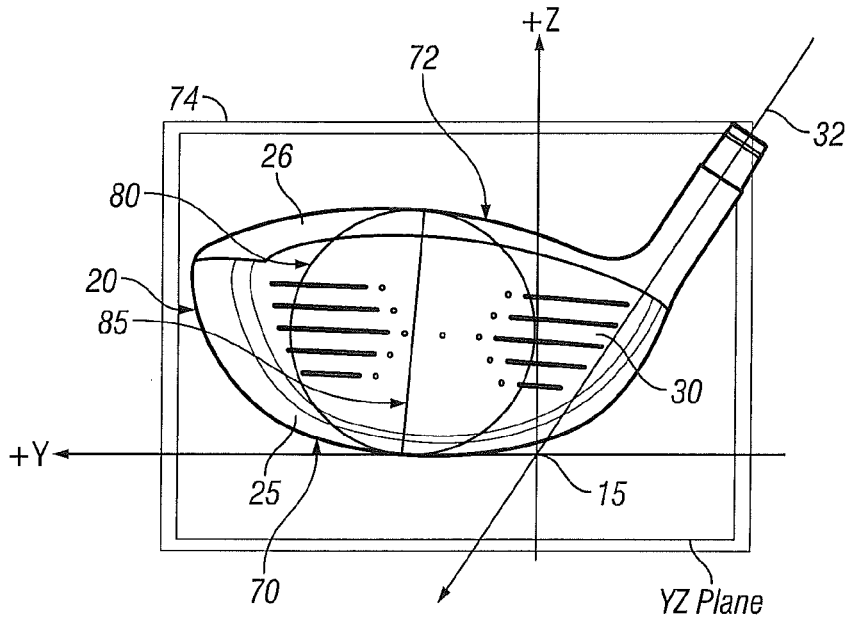
FIG. 8 is a perspective view of a golf club head superimposed on the Y and Z axes of a Cartesian coordinate system showing crown and sole silhouette curves, a line at the tangent points, and the largest tangent circle touching the crown and sole silhouette curves.
Figure 9:
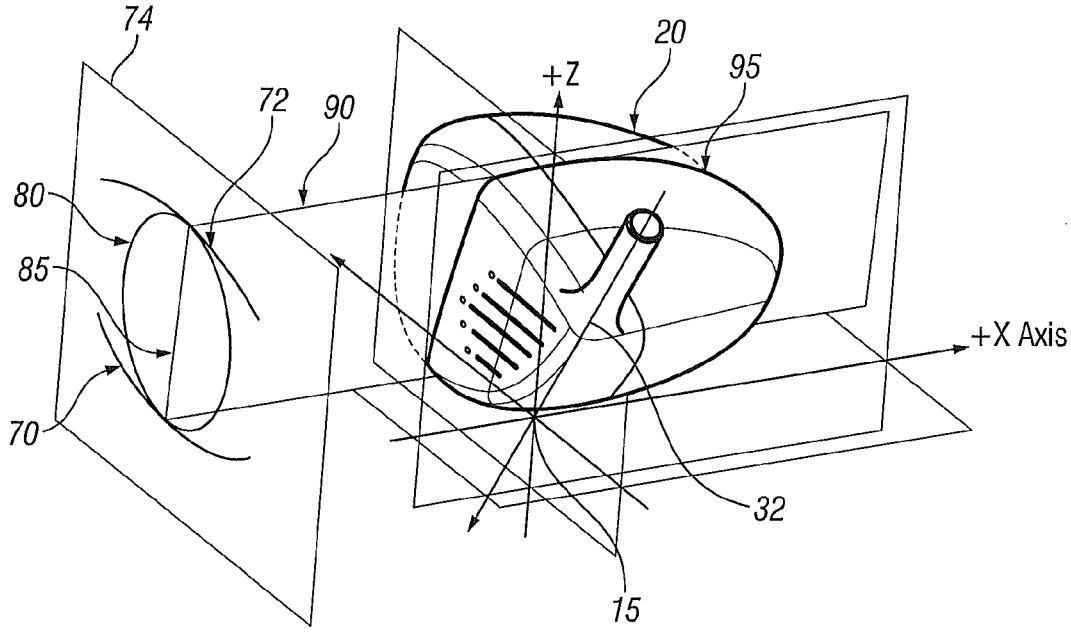
FIG. 9 is a three-dimensional perspective view of a golf club head superimposed on a Cartesian coordinate system showing a projected plane to derive two-dimensional intersection curves of the club head.

When the golf club head 20 is oriented as described above and in FIGS. 1-7, it is in the optimal position to obtain a preferred cross-sectional orientation through the club head. This can be accomplished using the Largest Tangent Circle Method (LTCM). Pursuant to the LTCM, and as shown in FIGS. 8 and 9, 3D silhouette curves of the sole 25 and crown 26 surfaces are projected onto a measurement plane 74, parallel to the YZ plane, along a vector parallel to the X axis, creating 2D curves 70, 72 on the measurement plane. A circle 80 is then placed on the measurement plane 74 between the projected 2D sole curve 70 and crown curve 72 and enlarged until the circle 80 has the maximum diameter possible, preferably rounded to the nearest 0.001 inch, and is tangent to both the projected curves 70, 72. As shown in FIG. 8, a line 85 is then drawn from the tangent point where the circle 80 touches the projected crown silhouette curve 72 to the tangent point where the circle touches the projected sole silhouette curve 70.

Figure 10:
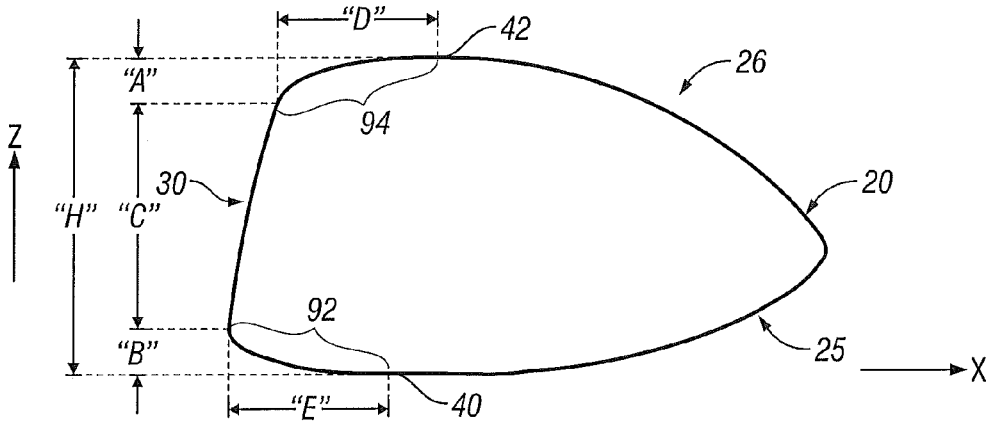
FIG. 10 is a two-dimensional cross sectional view of a golf club head showing dimensions of the club face and body.

As shown in FIG. 9, the line 85 created between the tangent points is projected in a direction parallel to the X axis, thus creating a plane 90 to derive the two-dimensional intersection curves 95 of the golf club head 20. These two-dimensional intersection curves 95 represent the outline or cross-section of the club head 20, as shown in FIG. 10, in an optimal orientation for determining the relationships between the face 30, crown 26, and sole 25 surfaces.

Computational Fluid Dynamics (CFD) analysis has shown that as the airflow moves from the face onto the crown and sole surfaces of the club head, it may accelerate and can promote negative drag on the transitional surfaces. According to the present invention, this desirable negative drag can be achieved by altering the dimensions A, B, C, D, E, and H, and preferably the dimensions A, B, D, and E, defined below, such that their values satisfy one or more of the following equations:

$((A+B)/C) \geqq 30\%$;

$A \geqq 0.36$ inches and $D > 1.0$ inch;

$B \geqq 0.3$ inches and $E > 1.0$ inch;

$A \geqq 0.25$ inches and $C \leqq 2.0$ inches;

$B \geqq 0.25$ inches and $C \leqq 2.0$ inches;

$A \geqq 0.25$ inches and $B \geqq 0.25$ inches AND $C \geqq 2.0$ inches; and $C/H < 80\%$.

Referring to the cross-section 95 derived according to the LTCM described above and in FIGS. 1-9, which is illustrated in FIG. 10, H is defined as a distance along the tangent line 85 between the crown apex point 42 and the face-most sole nadir point 40. C is defined as a distance along the tangent line 85 between the top of the club face 30 and the bottom of the club face 30. A is defined as a distance along the tangent line 85 between the top of the club face 30 and the crown apex point 42. B is defined as a distance along the tangent line 85 between the bottom of the club face and the face-most sole nadir point 40. D is defined as a distance along the X axis between the top of the club face 30 and the crown apex point 42. E is defined as a distance along the X axis between the bottom of the club face 30 and the face-most sole nadir point 40. The cross-section 95 also includes transitional surfaces 92, 94 between the face 30 and the sole 25 and crown 26 surfaces, the heights along the Z axis of which are represented by values A and B.

Figure 11:
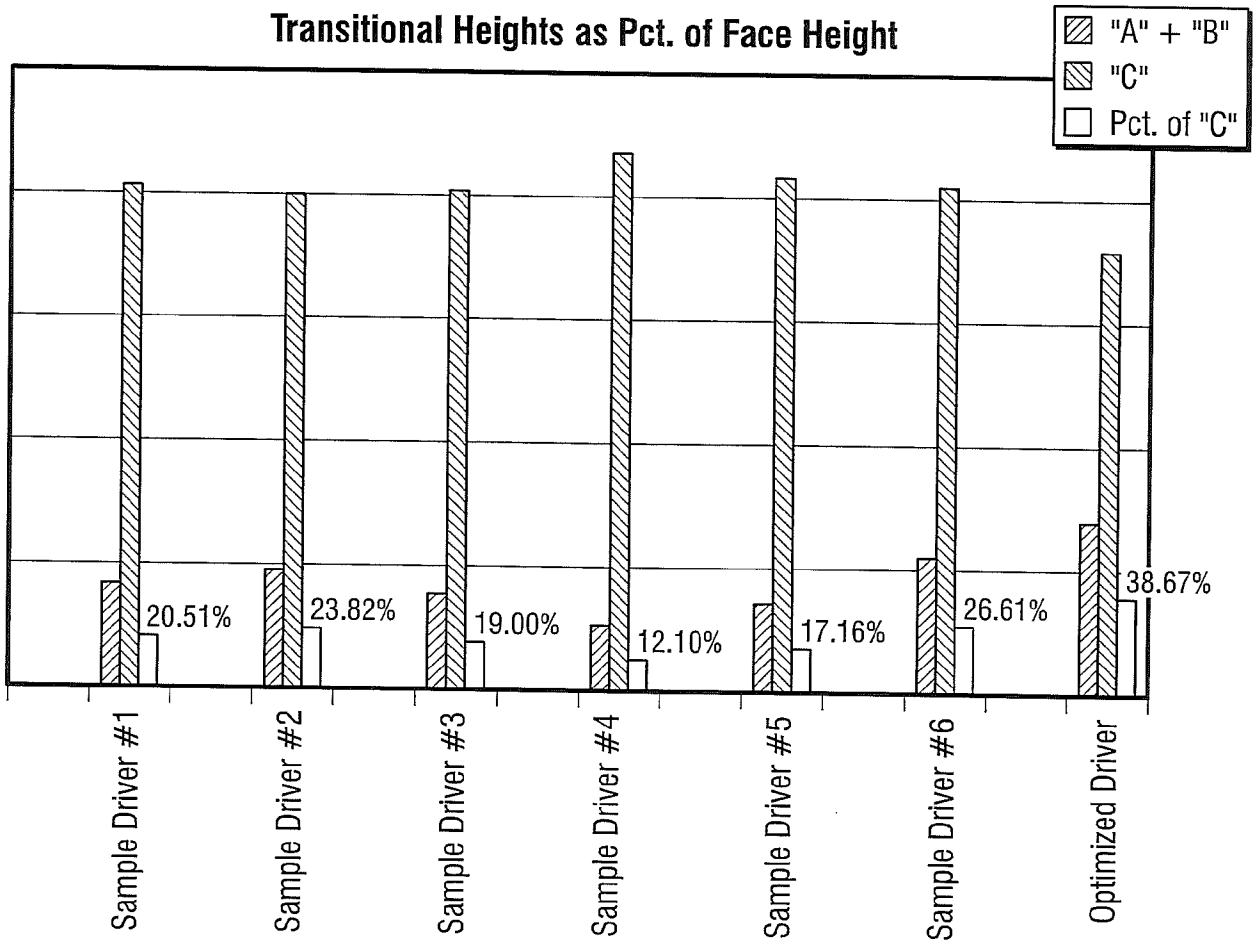
FIG. 11 is a chart showing the dimensions of six sample drivers in contrast with a driver whose dimensions are optimized according to the invention.

A preferred embodiment of the present invention is a driver having a shape optimized with regard to transitional heights A and B as a percentage of face height C, e.g., $((A+B)/C) \geqq 30\%$. When a driver optimized according to this embodiment is compared with six sample drivers, as shown in FIG. 11, it becomes evident that an optimized driver has a greater percentage of transitional height than sample drivers 1 through 6.

In a second embodiment of the present invention, when the golf club head 20 is oriented as described above according to the LTCM and as shown in FIGS. 1-9, it is in an optimal position to obtain design relationships of the overall projected silhouette of the club head to the area of its face 30. According to this embodiment of the present invention, the two-dimensional projected area of the face 30 surface of the golf club head is compared with the two-dimensional projected area of the club head 20, excluding any attached ferrule or shaft, and before artwork, scorelines, dots, and graphics are added to the club face.

Figure 12:
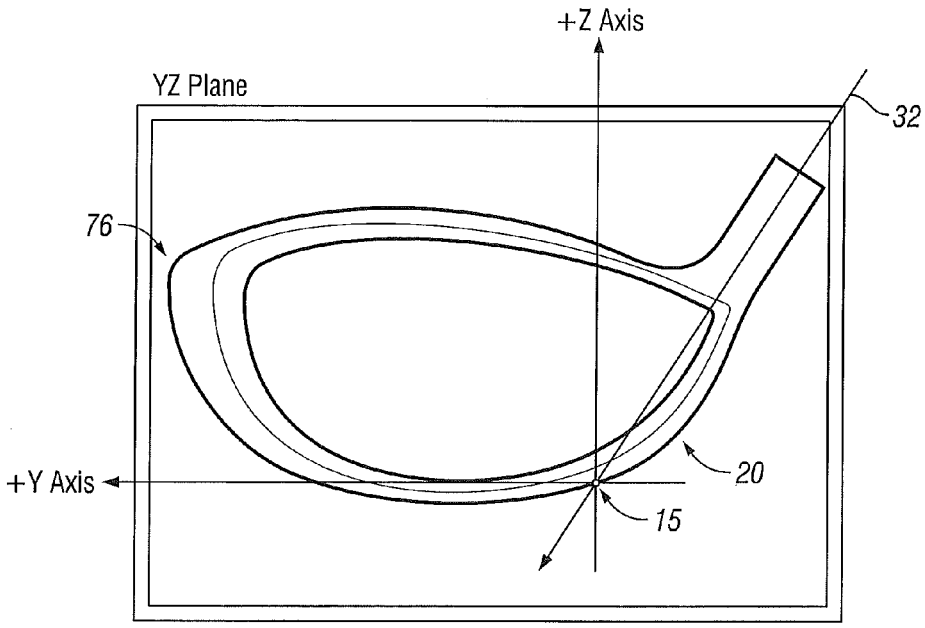
FIG. 12 is a perspective view of a golf club head superimposed on the Y and Z axes of a Cartesian coordinate system showing an origin point and the silhouette of the club head.
Figure 13:
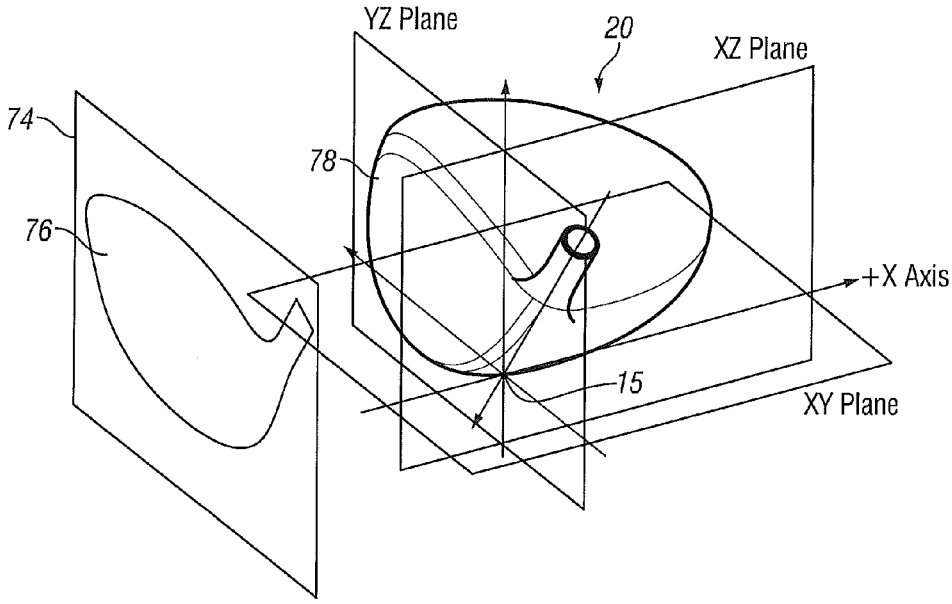
FIG. 13 is a three-dimensional perspective view of a golf club head superimposed on a Cartesian coordinate system showing a projected area of a silhouette of the club head on a plane parallel to the YZ plane.
Figure 14:
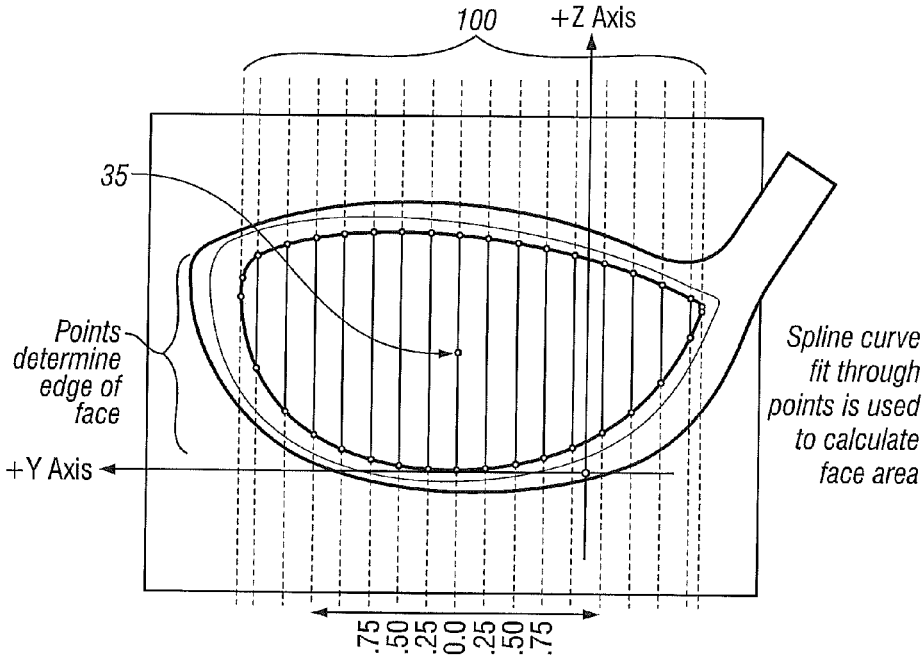
FIG. 14 is a perspective view of a golf club head superimposed on the Y and Z axes of a Cartesian coordinate system showing a face center point and the area of the club head face calculated using an 8 inch radius gage.

According to this second embodiment, the two-dimensional silhouette 76 of the club head 20 is obtained by projecting a plane 74 parallel to the YZ plane, as shown in FIGS. 12 and 13. The face area 78 of the club head 20 is obtained by using an 8.0 inch radius gauge as shown in FIG. 14. The radius gauge is kept parallel with the XZ plane and is touched against the club head 20 so that it contacts the top and bottom edges of the face 30. As illustrated in FIG. 14, each successive contact location 100 is at 0.25 inch increments towards the toe and heel from the face center point 35, with the exception of the last interval at the ends of the face. Each location 100 touched by the radius gauge is marked. A smooth spline curve is 'fit' or 'lofted' to the marked contact points to create a boundary that sufficiently defines the area of the face 30 of the club head 20.

Figure 15:
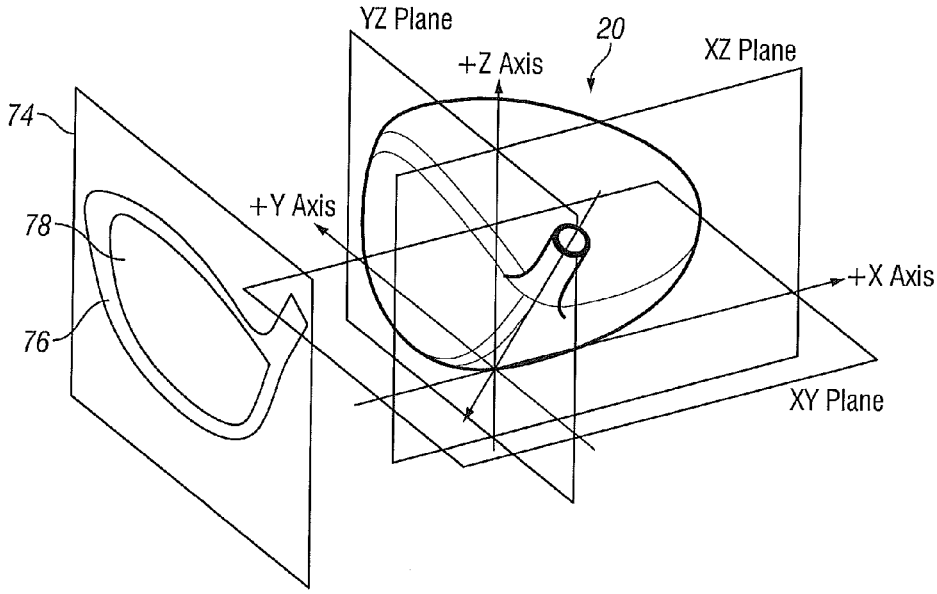
FIG. 15 is a three-dimensional perspective view of a golf club head superimposed on a Cartesian coordinate system showing projected areas of a silhouette of the club head and a silhouette of the club face on a plane parallel to the YZ plane.

The newly determined face boundary 78 is then projected onto the same plane 74 as the silhouette curves 76 of the club head to obtain the two-dimensional projected area of face 30, as shown in FIG. 15. The two-dimensional projected curves 78, 76 of the face boundary and the driver club head's silhouette curves are then obtained and measured using an optical comparator that can accurately report 1:1 projections.

Figure 16:
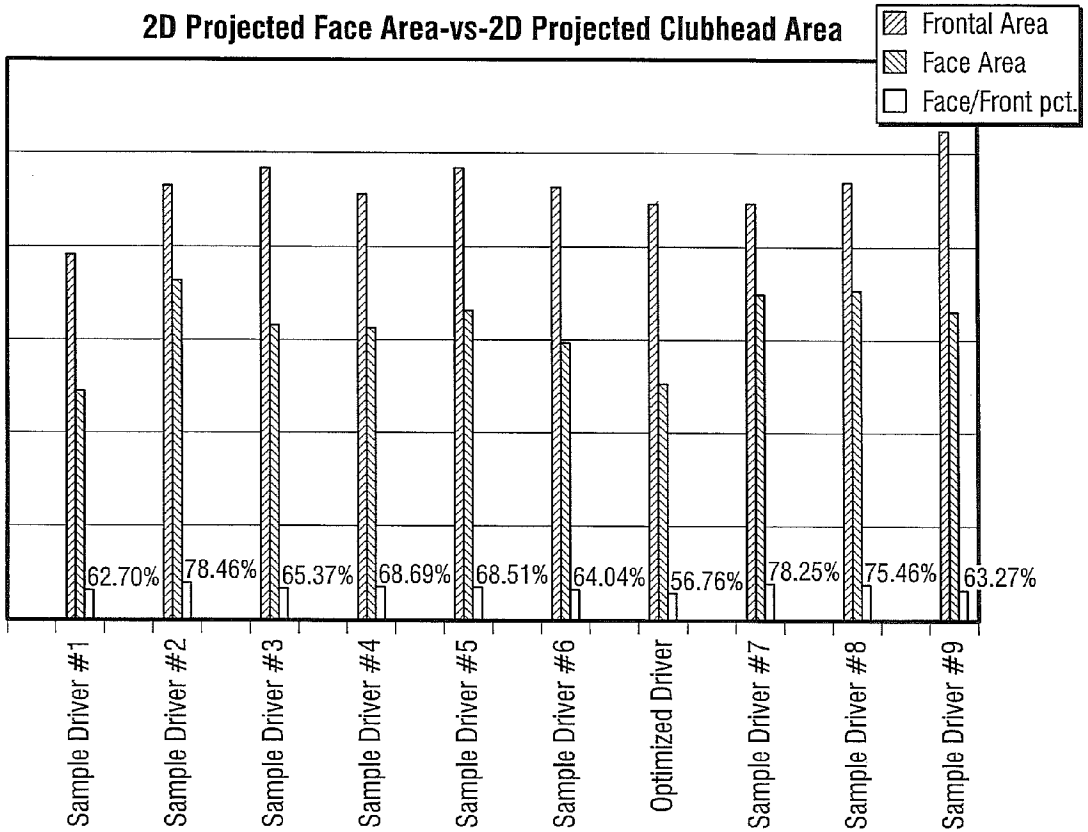
FIG. 16 is a chart showing the two-dimensional projected face areas and two dimensional projected club head areas of nine sample drivers and a driver optimized according to the invention.

According to the present invention, improvements in club head drag can be obtained by designing a club head wherein the two-dimensional projected face area 78 is below 60% of the overall two-dimensional projected area 76 of the driver club head 20. As demonstrated in FIG. 16, driver club head designs with poor aerodynamic features have face areas that are more than 59% of their overall projected club head areas. In other words, an optimized driver club head according to the present invention complies with the equation (2D projected face area/2D projected driver club head silhouette area) $\leqq 59\%$.

Computational Fluid Dynamics (CFD) analysis shows that the face 30 contributes significantly to the overall drag of the club head 20. Reducing the face area of the club head 20 according to the embodiments of the invention reduces the overall drag on the club head 20 in a proportional manner. In addition, when the face area of the club decreases, the designs of the transitional surfaces which connect the face to the body become influential in reducing club head drag. Though a large face area can provide the golfer with a hitting surface that is forgiving with regard to mishits and offers good compliance properties (Coefficient of Restitution and Characteristic Time), the present invention reveals that a balance of face area, transitional surface shape, and overall projected area of the club head are important to reduce the overall drag on the club head while at the same time providing a club that is easy to hit and acceptable to golfers.

Figure 17:
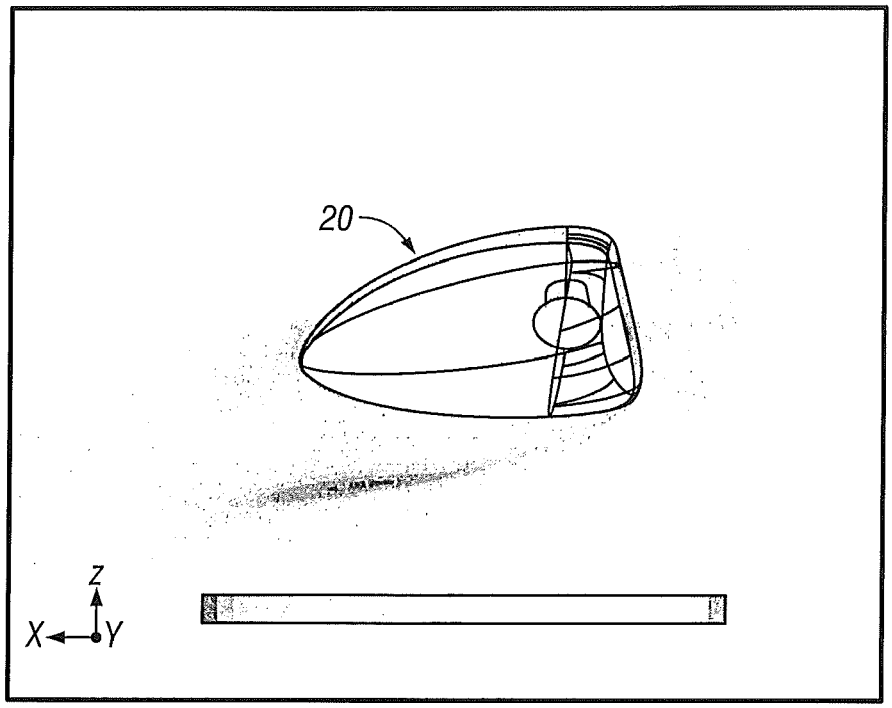
FIG. 17 is an image showing the airflow separation over the contours of a conventional club head design.
Figure 18:
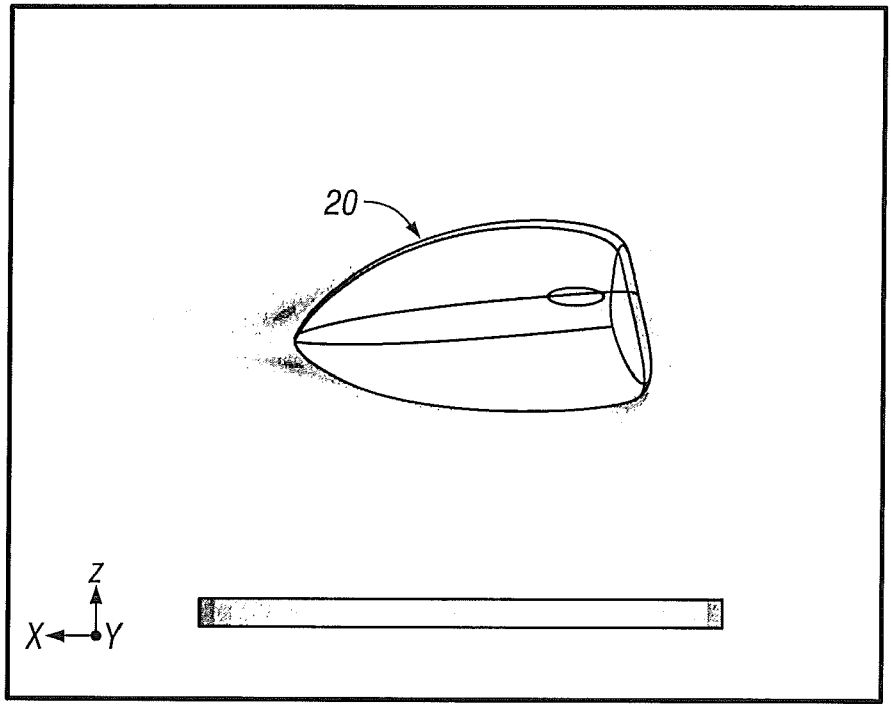
FIG. 18 is an image showing the airflow separation over the contours of a club head optimized according to the invention.

Driver type golf club heads 20 created using the methods discussed herein enable the golfer to benefit from an improved driver 20 design more suited to hitting shots with higher ball velocities due to the increased head speed produced by lower drag forces opposing the driver head 20 as it travels through the air. A conventional golf club head design that has not been optimized using the methods of the invention, shown in FIG. 17, has inferior air flow separation when compared to a golf club whose transitional surfaces have been optimized for drag reduction, shown in FIG. 18. CFD analysis shows that optimizing transitional surfaces of the club head reduces drag by over 100% when compared with conventional golf club heads.

The designs of the present invention have crown surfaces with increased curved shapes when compared to conventional golf club heads, and have apex points that are higher and farther back from the top of the face than conventional designs. Similarly, the nadir points on the soles of the driver club heads of the invention are lower and further away from the bottom of the face. These design changes lead to a reduction in the face area. While making faces too small may lead to undesirable club performances, making the faces smaller in ways that still provide adequate hitting zones can produce a high performing and forgiving face as well as allow the apex and nadir points of the club head to be located optimally for reduced drag on the club head.

The golf club head 20 of the present invention may be made of one or more materials, may include variable face thickness technology, and may have one or more of the structural features described in U.S. Pat. No. 7,163,468, U.S. Pat. No.

7,163,470, U.S. Pat. No. 7,166,038, U.S. Pat. No. 7,214,143, U.S. Pat. No. 7,252,600, U.S. Pat. No. 7,258,626, U.S. Pat. No. 7,258,631, U.S. Pat. No. 7,273,419, each of which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A driver type golf club head comprising:

a body having a face, a crown and a sole;

wherein the crown has an apex point, wherein the sole has a nadir point, wherein H is a distance between the crown apex point and the sole nadir point, wherein C is a face height, wherein A is a distance between the highest point of the face and the crown apex point, wherein B is a distance between the lowest point of the face and the sole nadir point, wherein D is a distance between the highest point of the golf club face and the crown apex point, wherein E is a distance between the lowest part of the golf club face and the sole nadir point, and wherein the driver club head satisfies one or more of the following equations:

$$((A+B)/C) \geqq 30\%; \quad \text{(a)}$$

$$A \geqq 0.36 \text{ inches and } D > 1.0 \text{ inch}; \quad \text{(b)}$$

$$B \geqq 0.3 \text{ inches and } E > 1.0 \text{ inch}; \quad \text{(c)}$$

$$A \geqq 0.25 \text{ inches and } C \leqq 2.0 \text{ inches}; \quad \text{(d)}$$

$$B \geqq 0.25 \text{ inches and } C \leqq 2.0 \text{ inches}; \quad \text{(e)}$$

$$A \geqq 0.25 \text{ inches}, B \geqq 0.25 \text{ inches, and } C \geqq 2.0 \text{ inches; and} \quad \text{(f)}$$

$$C/H < 80\%. \quad \text{(g)}$$

2. A driver type golf club head according to claim 1 wherein the driver type golf club head has a volume of at least 400 cubic centimeters.

3. A driver type golf club head according to claim 1 wherein the driver type golf club head has a loft measurement of less than 14 degrees.

4. A driver type golf club head according to claim 1 wherein the face is composed of a metal material.

5. A driver type golf club head according to claim 1 wherein the body is composed of a stainless steel material.

6. A driver type golf club head according to claim 1 wherein the sole is composed of a metal material and the crown is composed of a non-metal material.

7. A driver type golf club head according to claim 1 wherein the body is composed of a titanium alloy material.

* * * * *